United States Patent [19]

McIntosh

[11] 4,254,901

[45] Mar. 10, 1981

[54] DOUBLE SHOULDERED GUITAR STRAP

[76] Inventor: Hugh C. McIntosh, 4338 Coronado Ave., San Diego, Calif. 92107

[21] Appl. No.: 73,421

[22] Filed: Sep. 7, 1979

[51] Int. Cl.[3] ..... A45F 5/00

[52] U.S. Cl. ..... 224/258; 224/910; 224/259

[58] Field of Search ..... 224/209, 208, 215, 257, 224/259, 910, 258

[56] References Cited

U.S. PATENT DOCUMENTS

| | | | |
|---|---|---|---|
| 860,794 | 7/1907 | Felts | 224/259 |
| 2,996,228 | 8/1961 | Bauman | 224/259 X |
| 3,152,738 | 10/1964 | Worsfeld, Jr. | 224/259 |
| 3,326,432 | 6/1967 | Banks et al. | 224/258 |
| 3,507,424 | 4/1970 | Burkins | 224/257 |
| 3,583,600 | 6/1971 | Scott | 224/209 X |
| 4,168,022 | 9/1979 | Brewer | 224/257 |

*Primary Examiner*—Steven M. Pollard
*Attorney, Agent, or Firm*—Ralph S. Branscomb

[57] ABSTRACT

A load bearing strap is provided designed primarily for use with a guitar having a pair of straps, one of which passes over the left shoulder and through a back bracket down around the right to engage the bottom of the guitar, and the other passing from the bracket up over the right shoulder so that the end of the left strap and the right strap meet in front of the user to engage the suspension peg positioned near the top of the guitar body.

2 Claims, 3 Drawing Figures

DOUBLE SHOULDERED GUITAR STRAP

BACKGROUND OF THE INVENTION

Gluitar players, and primarily professional guitar players, have a real problem with guitar suspension straps currently in use in that they only suspend a guitar from one shoulder. Over a period of time, often several hours, the strap weighs very heavily on the player and tends to strain his back and neck. For this reason, guitar players are constantly shifting the strap from one shoulder to the next to evenly distribute the burden. However, because no matter how the strap is used, it still bears on a single shoulder only, it exerts an unnecessary stress on the body.

SUMMARY OF THE INVENTION

The present invention alleviates the above-mentioned problem by providing a strap specifically tailored to the needs of a guitar player and having a specially designed bracket positioned behind the guitar player's back having two connectors thereon, there being a single long strap passing over the left shoulder to the front of the guitar player and around his right side to engage the guitar at two suspension pegs, and an additional strap passes from the bracket up over the right shoulder and down to engage the top guitar suspension peg so that the weight of the guitar is evenly suspended upon both shoulders of the player and additional stability is provided by engagement at the bottom suspension peg of the guitar.

DETAILED DESCRIPTION OF THE PREFERRED EMBODIMENT

Figure 1:
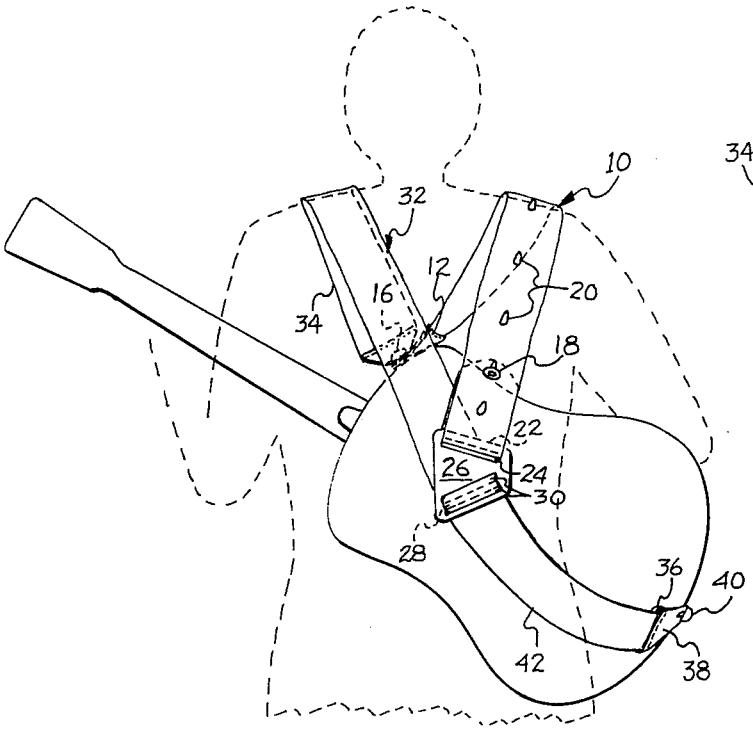
FIG. 1 is a rear elevation view showing the guitar through the body of the user.
Figure 2:
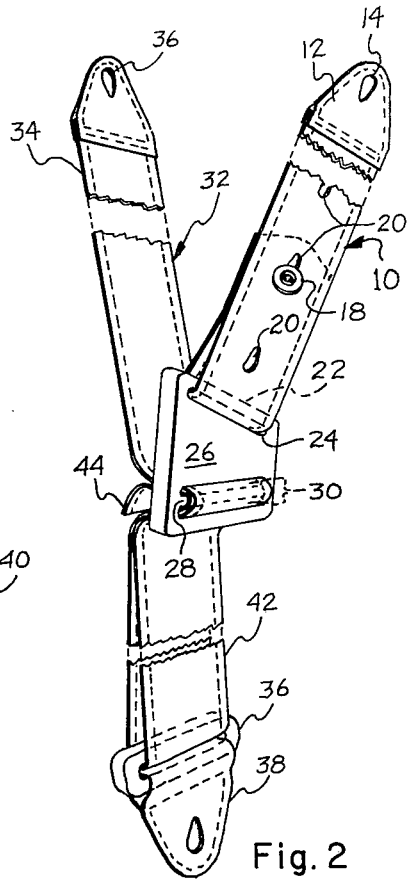
FIG. 2 is a perspective view of the guitar strap in isolation.
Figure 3:
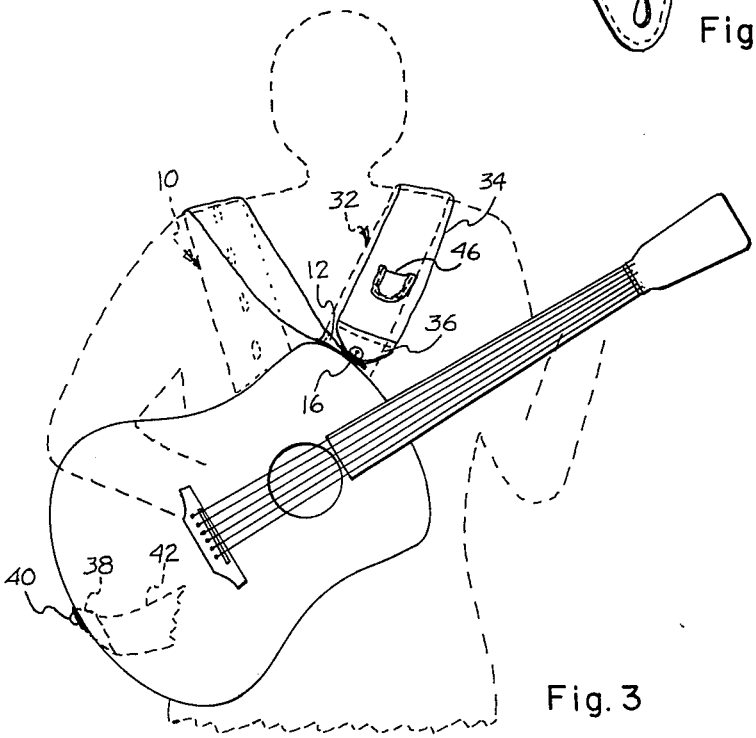
FIG. 3 is a front elevation view of the strap shown in use suspending a guitar.

FIG. 2 provides an overall view of the guitar strap wherein a first strap 10 is shown having an end 12 reinforced with leather or the like in its preferred form and having an attachment means such as eyelet 14 for connecting to the top mounting peg 16 of the guitar as seen in FIGS. 1 and 3. This strap is adjustably mounted by virtue of a button 18 and buttonholes 20 in a first bar 22 defined by a void 24 in the strap connecting bracket 26. Other ways of adjusting the strap 10, such as with Velcro $^R$ fasteners or the like, are of course possible.

It will be noted that the upper, first bar 22 is defined at a significant angle relative to a lower bar 28 which is defined by a pair of voids 30 in the lower portion of the bracket. Through this lower bar passes a second strap 32 which has a left portion 34 with an apertured reinforced tip 36 similar to the end 12 of the first strap. This left portion of the second strap passes over the left shoulder, with the first strap 10 passing over the right shoulder as best shown fin FIG. 3 to engage the top suspension peg 16 of the guitar.

The second strap 34 immediately passes through the second, lower bar 28 and continues down through elongated eyelet 36 which mounts an apertured guitar attachment 38. This right-hand portion of the second strap loops around to define an enclosed loop 42 and again passes through the apertures defining the bar 28 terminating in the end 44. By virtue of this loop it can be seen that by varying the proportion of the second strap which constitutes the loop 42 versus the left portion 34, or even lengthening or shortening the portion defining the loose end 44, the left strap can be lengthened or shortened in its left or right portion, independently or together.

The strap can be made of different materials, provided they are flexible, such as leather, demin, vinyl, plastic, or the like. It is important that the portion of the strap passing over the shoulders be fairly broad, and it could even be padded, to accomplish the function of relieving the strain on the guitar player. Means of attachment and means of lengthening could of course also be modified in different embodiments of the invention falling within the appended claims.

Another noteworthy feature of the device is an optional pocket 46 defined in the left portion of the second strap. This pocket serves as a storage for the different picks that the player will need from time to time during a session. Traditionally, the player must keep it in his pants pocket, between his teeth, or in another nonspecific location.

The invention is thus described and claimed. It is simple to manufacture and will provide a real benefit to the guitar playing community, and especially to those professional musicians who must spend hours at a time behind their instrument.

What is claimed is:

1. A two-shouldered strap for supporting a load suspended frontally of the user comprising:

(a) a planar bracket positioned behind the back of the user and having a first connector comprised by an elongated void adjacent one edge of said bracket and a second connector comprising a bar divided by two parallel elongated slots in said bracket;

(b) a first strap connected to said first connector and extending forwardly over the right shoulder of the user and having attachment means on the end thereof for connection to said load;

(c) a second strap having a left portion to extend over the left shoulder of the user into one of the slots and out of the other of said slots around the second mentioned bar, and a right portion to extend from said second connector down around the right side of the user, and a return portion continuing from said right portion back up through said second connector flush against the medially portion in said second connector, said second strap having an end terminating on the side of said second connector remote from said right portion, whereby upon pulling said end singly through said second connector the right portion of said second strap is length-adjusted, and upon pulling both said medially and return strap portions simultaneously through said second connector the position of said bracket on said second strap is adjusted, with both ends of said second strap having means of attaching same to said load, whereby said load is evenly borne by both shoulders of the user and steadied against lateral instability and a single bracket with no moving parts can make all necessary adjustments of both straps.

2. The structure according to claim 1 wherein one of said straps defines a pocket.

* * * * *